US007938885B2

(12) United States Patent
Huang

(10) Patent No.: US 7,938,885 B2
(45) Date of Patent: May 10, 2011

(54) DEVICE FOR THE REMOVAL OF SOOT DUST OF FUEL OIL COMBUSTION

(76) Inventor: Qingbao Huang, Fo Shan (CN)

( * ) Notice: Subject to any disclaimer, the term of this patent is extended or adjusted under 35 U.S.C. 154(b) by 375 days.

(21) Appl. No.: 11/568,854

(22) PCT Filed: May 8, 2004

(86) PCT No.: PCT/CN2004/000452

§ 371 (c)(1),
(2), (4) Date: Nov. 9, 2006

(87) PCT Pub. No.: WO2005/107925

PCT Pub. Date: Nov. 17, 2005

(65) Prior Publication Data

US 2008/0257157 A1 Oct. 23, 2008

(51) Int. Cl.
*B03C 30/14* (2006.01)

(52) U.S. Cl. ..... 95/65; 95/69; 95/71; 96/53; 96/57

(58) Field of Classification Search ..... 96/297, 96/47, 57, 52, 53, 74; 95/65, 64, 63, 69, 95/71

See application file for complete search history.

(56) References Cited

U.S. PATENT DOCUMENTS

| | | | | |
|---|---|---|---|---|
| 4,194,889 | A | 3/1980 | Wanner | |
| 4,331,447 | A * | 5/1982 | Kamada et al. | 44/574 |
| 4,750,916 | A | 6/1988 | Svensson | |
| 4,762,526 | A * | 8/1988 | Funaji et al. | 44/627 |
| 6,126,014 | A * | 10/2000 | Gray et al. | 209/163 |
| 2003/0235525 | A1 * | 12/2003 | Honjo et al. | 423/210 |
| 2004/0033172 | A1 * | 2/2004 | Shimizu et al. | 422/169 |
| 2004/0047773 | A1 * | 3/2004 | Kato et al. | 422/172 |
| 2004/0208809 | A1 * | 10/2004 | D'Alesandro | 423/243.08 |

FOREIGN PATENT DOCUMENTS

| | | |
|---|---|---|
| CN | 86105168 | 2/1987 |
| CN | 2440567 | 8/2001 |
| CN | 2612440 | 4/2004 |
| CN | 2616274 | 5/2004 |
| CN | 1548215 | 11/2004 |

OTHER PUBLICATIONS

Wancheng et al., Wet Dedusting Screen, Apr. 2004, CN 86105168, China, 45/10.*

International Search Report, PCT/CN2004/000452; date of mailing ISR: Feb. 24, 2005; 4 pages.

* cited by examiner

*Primary Examiner* — Duane Smith
*Assistant Examiner* — Tiffany N Palmer
(74) *Attorney, Agent, or Firm* — Schmeiser, Olsen & Watts, LLp

(57) ABSTRACT

A device designed for the removal of soot dust of fuel oil combustion. The device is based on the two-stage wet-electrostatic dust removal-desulfurization device, with different numbers of layers of the mesh screen being installed in the wet type dust removal-desulfurization device. This device not only has a relatively high efficiency in both of common dust removal and desulfurization, but also can remove the black smoke from fuel oil combustion efficiently with a removal efficiency ≧99%, and thus solves the present technical problem in the treatment of in the treatment of soot dust of fuel oil combustion. At the same time, with the advantages of cheaper construction cost and economy, the device of the present invention overcomes the disadvantages of the traditional bag filter process, which is expensive and cannot operate desulfurization simultaneously.

8 Claims, 1 Drawing Sheet

DEVICE FOR THE REMOVAL OF SOOT DUST OF FUEL OIL COMBUSTION

BACKGROUND OF THE INVENTION

1. Field of the Invention

The present invention relates to a kind of air pollution treatment device, and more particularly to an integrative device with two-stage wet-electrostatic process for dust removal-desulfurization, and for removal of soot dust of fuel oil combustion.

2. Description of the Prior Art

With the use of fuel oil instead of coal, the air pollution of industrial and domestic soot dust (black smoke) of fuel oil combustion has become more and more serious. However, since the soot dust (black smoke) of fuel oil combustion is mainly made of soot due to uncompleted combustion, and black carbon and a small amount of impurities formed during combustion process. The soot dust (black smoke) of fuel oil combustion has the characteristics of high temperature (usually 200-300° C.), oiliness, superfine particle (usually <1 μm), small specific resistance ($\leqq 10^3$ ohm*centimeter (Ω·cm)) and small density. The soot dust is of poor hydrophilic (hydrophobic nature) and is contained of corrosive gases (such as $SO_2$ and HF). The treatment of the soot dust (black smoke) of fuel oil combustion has always been a technical problem in the field of environmental protection. The existing removal technique of soot dust (black smoke) of fuel oil combustion mainly includes ESP, wet process for dust removal-desulfurization, bag filter and two-stage wet process-electrostatic dust removal-desulfurization. Due to the low specific resistance of the dust ($\leqq 10^3$ ohm*centimeter), which is beyond the scope of that of the ESP process ($10^4$-$5*10^{10}$ ohm*centimeter (Ω·cm)), the phenomenon of the black smoke return flow is serious, therefore the technique of ESP has poor efficiency in black smoke removal. As the soot dust has the characteristic of superfine particles and hydrophobic nature, with the wet process for dust removal-desulfurization, the black smoke cannot be removed efficiently too. Though bag filter has a high removal efficiency of black smoke, with the characteristics of high temperature, oiliness and corrosiveness of soot dust, the request for material selection of bag is especially high, and cooling measure is required, all which will result in high construction cost and impossible for simultaneous desulfurization. Therefore, bag filter is rarely used. The newest used two-stage wet type-electrostatic dust removal-desulfurization device, disclosed in CN Pat. No. 03225616.7, has a high efficiency in both dust removal and desulfurization, but due to the soot dust characteristics of low specific resistance, superfine particles and hydrophobic nature, the removal of black smoke is inefficient and cannot reached the requirement of environmental protection.

The present invention has arisen to mitigate and/or obviate the afore-described disadvantages.

SUMMARY OF THE INVENTION

The primary objective of the present invention is to provide a device for removing soot dust of fuel oil combustion, which not only has a relatively high efficiency in both of common dust removal and desulfurization, but also can remove the black smoke of fuel oil combustion efficiently.

The present invention is based on an integrative device with two-stage wet-electrostatic process for dust removal-desulfurization, disclosed in CN Pat. No. 03225616.7, with different numbers of layers of mesh screen internally installed in the wet dust removal-desulfurization device. The mesh screen is tangential arranged to the smoke flow. When entering the wet type dust removal-desulfurization device, under the function of the water gravity and the fan gravitation, the smoke must force through the tiny holes of the mesh screen. While the soot dust (black smoke) and water force through the mesh screen together, the soot dust (black smoke) is surrounded and extruded by water, and the multi-layers of mesh screen make the surrounded and extruded repetitiously, along with intensively collision. Thereby, on the one hand, the soot and black carbon are forcibly contacted with water sufficiency until the soot and black carbon are being totally or partly hydrophilic by water, or partly surrounded by water. On the other hand, the self-extruded and self-collided of soot and black carbon will form bigger and thicker particles. When the soot dust and water are forced to be compatible while passes through the holes of the mesh screen, the temperature-heat energy of the smoke plays an active catalytic effect. Before entering the spraying tower, the temperature of smoke is high (200-300° C.). When entering the spraying tower, the smoke contacted with water adequately, and the heat of the smoke being absorbed. This cause the smoke's temperature to dropped to ≦100° C., and help water to obtain a certain temperature. With the obtained temperature, water can ensure the activation of the water molecules and play an active catalytic effect in the hydrophilic of the soot and black carbon. When the soot and black carbon are hydrophilic, due to the high specific resistance and gravity of the water, the water serves as a friction intensifier, a weighting agent and an adhesive, which overcome the drawbacks of the hydrophobic nature, low specific resistance, superfine particles and small density, so as to enable the specific resistance of the soot and black carbon to reach the specific resistance scope ($10^4$-$5*10^{10}$ ohm*centimeter (Ω·cm)) of ESP. Thereby, when the hydrophilic soot and black carbon entered ESP-desulfurization device via a smoke duct, it can be easily separated from the smoke by the electrostatic coulomb power and will not be returned. Then, by passing through an automatic cleaning device, the black smoke is washed away to a tank, thus reaching the purpose of removing the black smoke efficiently.

Through replication experiments of the present invention, results show that: the removal efficiency of black smoke from fuel oil combustion is related to the number and layers of the mesh screen installed inside the wet process device for dust removal-desulfurization. The more number and layers of the mesh screen, the more chances that the soot and black carbon being surrounded, extruded and collided with water, therefore a better hydrophilic and a higher efficiency of dust removal will be. However, at the same time, the fan's wind pressure loss goes larger, and energy consumption goes higher. The screen mesh and layers of the mesh screen, which installed in the wet process dust removal-desulfurization device, has the removal efficiency of soot dust (black smoke) range from 4-1000 meshes and 1-500 layers respectively, and optimally range from 18-30 meshes and 18-30 layers respectively. The tangent angle of the internal installed mesh screen with the flow direction of the soot dust ranges from 10°-90°, and optimally ranges from 60°-90°. In addition, in order to reduce the wind pressure loss of the fan, the flow direction of the smoke is usually the same as that of the spraying water, which is usually from top to bottom. With such an arrangement, part of the water's potential energy loss can be translate into wind energy, so as to reduce the wind pressure, thus reaching the purpose of energy saving.

The present invention has the following notable effects: The invention not only has a relatively high efficiency of common dust removal and desulfurization, but also can remove the black smoke from fuel oil combustion efficiently with a removal efficiency ≧99%, and thus solves the present technical problem in the treatment of soot dust of fuel oil combustion. At the same time, with the advantages of cheaper construction cost and economy, the device of the present invention overcomes the disadvantages of the traditional bag filter process, which is expensive and cannot operate desulfurization simultaneously.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
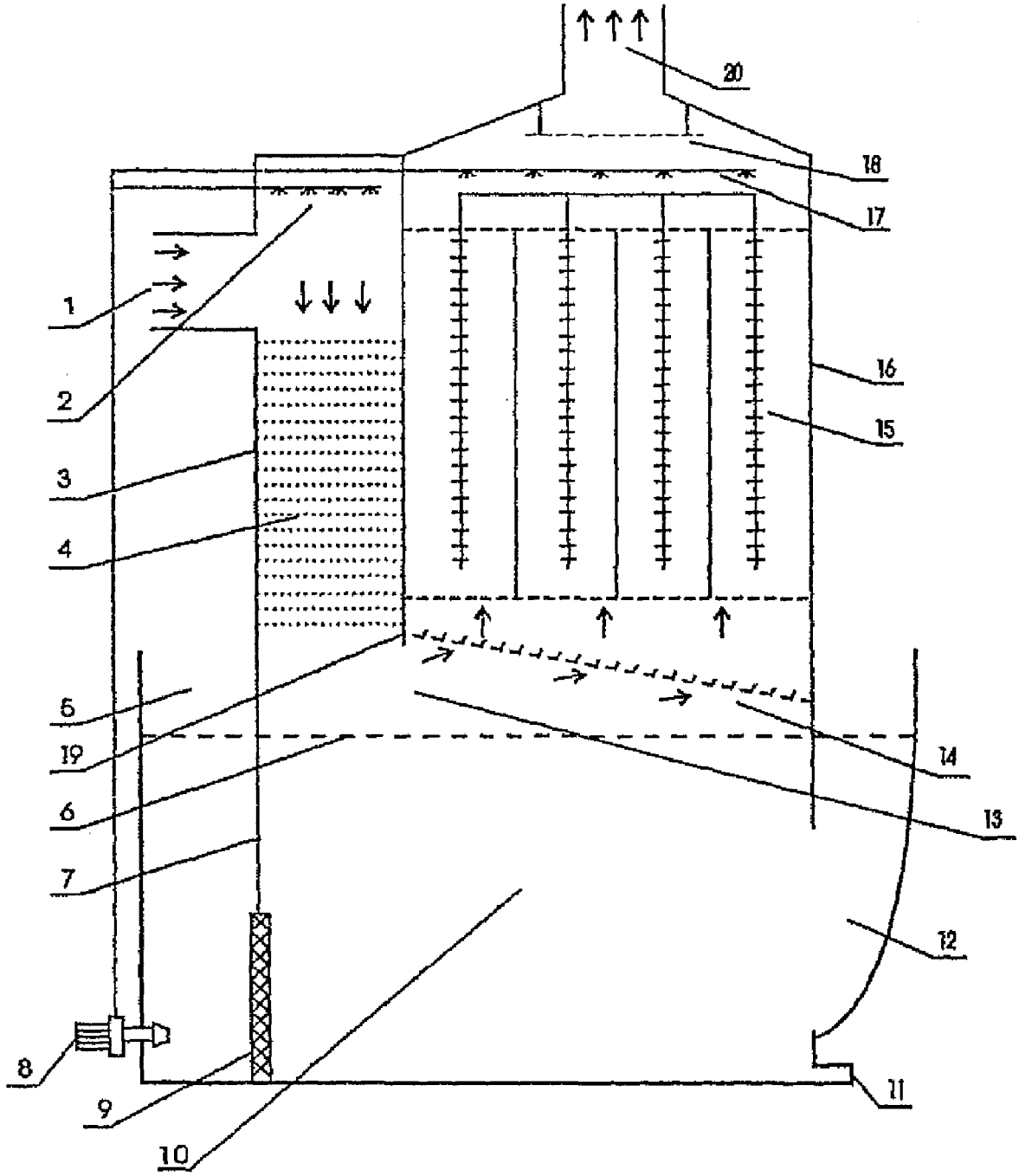
FIG. 1 is the constructional drawing of a dust removal device for soot dust of fuel oil combustion, in accordance with the present invention.

Referring to FIG. 1, dust removal device for soot dust of fuel oil combustion, in accordance with the present invention comprises a wet-type dust removal-desulfurization device 3, an ESP-desulfurization device 16 and a tank 10. The tank 10 is divided into clear water tank and waste water tank by a partition board 7 located at the center of the tank 10, the lower part of the partition board 7 is installed with a filter screen 9, which enabling the waste water being filtered before flowing into the clear water tank. On one side of the tank 10, a manual dust-removing mouth 12 is designed under the water interface 6, while a wastewater discharge outlet 11 is set at the lower part of the tank 10. On the other side of the tank 10, an agent-filling opening 5 is designed above the water interface 6. The wet type dust removal-desulfurization device 3 and the ESP-desulfurization device 16 are connected to the upper part of the tank 10 and are separated by a partition board 19. Thus the wet type dust removal-desulfurization device 3, the ESP-desulfurization device 16 and the water interface 6 formed a closed body. A smoke duct 13 is located above the water interface 6 of the tank 10. Different numbers of layers of mesh screen 4 is installed in the wet type dust removal-desulfurization device 3, and the mesh screen 4 is tangent to the direction of smoke flow at 10°-90°. A wind inlet 1 is designed in the upper part of the wet type dust removal-desulfurization device 3, and a water-spray device 2 is installed on the top of the wet type dust removal-desulfurization device 3, so that the flow direction of the smoke is the same as that of the spraying water from top to bottom. A soot dust guiding board 14 is mounted on the lower part of the ESP-desulfurization device 16 that enables the smoke dust to enter the ESP-desulfurization device 16 evenly. The center of ESP-desulfurization device 16 is an electrostatic dedusting body 15, an automatic cleaning device 17 is mounted on the upper part of ESP-desulfurization device 16, and a even-flow board 18 and a wind outlet 20 is located on the top of ESP-desulfurization device 16. Via a water pump 8, the water pipe in the clear water tank of the tank 10 is connected to the water spraying device 2 of the wet type dust removal-desulfurization device 3 and the automatic cleaning device 17 of the electrostatic dust removal-desulfurization device 16.

The process is described as follows: Through the wind inlet 1, the soot dust (black smoke) enters the wet type dust removal-desulfurization device 3 first for the first-stage dust removal-desulfurization treatment. When the soot dust (black smoke) passes through the holes of the mesh screen 4 together with water, the smoke soot and black carbon of the smoke dust will be hydrophilic forcibly, thus creating a necessary condition for the second-grade electrostatic dedusting. Then, the primary purified soot dust (black smoke) enters the ESP-desulfurization device 16 via the smoke duct 13 for the second-stage dust removal-desulfurization treatment. After being hydrophilic, the specific resistance of the soot and black carbon is increased to reach the specific resistance scope of the high electrostatic dedusting efficiency, the ESP-desulfurization device 16 can remove the black smoke (soot and black carbon) from the smoke efficiently, and will not returned to the airflow, thus reaching the purpose of removing the smoke dust (black smoke) efficiently. Furthermore, being adsorbed in the electrostatic dedusting body 15 of the ESP-desulfurization device 16, the black smoke (soot and black carbon) can be washed away to the tank 10 via the automatic cleaning device 17.

While we have shown and described various embodiments in accordance with the present invention, it should be clear to those skilled in the art that further embodiments may be made without departing from the scope of the present invention.

What is claimed is:

1. A device for removing soot dust of fuel oil combustion, comprising:

a wet type dust removal-desulfurization device;

a water-spray device being set on a top of the wet type dust removal-desulfurization device;

a mesh screen having 18-30 layers and 18-30 meshes whose tangent angle to a flow direction of the soot dust ranges from 60° to 90°, wherein the mesh screen is set in the wet type dust removal-desulfurization device;

an electrostatic precipitator (ESP)-desulfurization device having an automatic cleaning device and an even-flow board being set on a top of the ESP-desulfurization device, wherein an electrostatic dedusting body is a center part of the ESP-desulfurization device, the ESP-desulfurization device also having a soot dust guiding board mounted on a lower part of the ESP-desulfurization device, further wherein both the even-flow board and the soot dust guiding board evenly regulate the soot dust flowing through the ESP-desulfurization device; and a tank, wherein the wet type dust removal-desulfurization device and the ESP-desulfurization device are connected to an upper part of the tank being separated by a first partition board;

wherein a smoke duct is formed above a water interface of the tank, the soot dust of fuel oil combustion flows from the wet type dust removal-desulfurization device into the ESP-desulfurization device for soot dust removal and desulfurization via the smoke duct and the soot dust guiding board.

2. A device for removing soot dust of fuel oil combustion according to claim 1, wherein the tank is divided into a clear water tank and a waste water tank by a second partition board located at a center of the tank, further wherein a filter screen is set on a lower part of the second partition board to enable the waste water to be filtered before flowing into the clear water tank.

3. A device for removing soot dust of fuel oil combustion according to claim 2, further including a manual dust-removing mouth located on one side of the tank under the water surface, a wastewater discharge outlet set at a lower part of the tank, and an agent-filling opening located on the other side of the tank above the water surface.

4. A device for removing soot dust of fuel oil combustion according to claim 2, further including a wind inlet set in an upper part of the wet type dust removal-desulfurization device, a wind outlet located on the top of the ESP-desulfurization device, wherein the even-flow board is set under the wind outlet.

5. A device for removing soot dust of fuel oil combustion according to claim 2, wherein a water pipe in the clear water tank is connected to the water-spray device of the wet type dust removal-desulfurization device and the automatic cleaning device of the ESP-desulfurization device via a water pump.

6. A method of removing soot dust of fuel oil combustion using the device of claim 1, comprising:

spraying water to the soot dust of fuel oil combustion from top to bottom as the same flow direction of the soot dust of fuel oil combustion by a water-spay device, the soot dust of fuel oil combustion being forcibly hydrophilic with water, the soot dust of fuel oil combustion being surrounded and extruded by water while forcing through a mesh screen having several layers and meshes together with water, by which surface physical properties of the soot dust of fuel oil combustion are changed, including overcoming a drawback of the hydrophobic nature and increasing a specific resistivity of the soot and black carbon in the soot dust of fuel oil combustion;

removing the soot and black carbon, whose surface physical properties have been changed, by an electrostatic precipitator (ESP)-desulfurization device; and washing away the soot and black carbon collected by the ESP-desulfurization device to a tank.

7. A method of removing soot dust of fuel oil combustion according to claim 6, wherein a temperature-heat energy of a smoke of fuel oil plays an active catalytic effect to a reaction of the soot dust and black carbon, being hydrophilic with water.

8. A method of removing soot dust of fuel oil combustion according to claim 6, wherein the mesh screen has 18-30 layers and 18-30 meshes.

* * * * *